United States Patent [19]

Wicker et al.

[11] Patent Number: 4,915,050

[45] Date of Patent: Apr. 10, 1990

[54] STEERING MECHANISM FOR OUTBOARD MOTOR

[76] Inventors: Ronald E. Wicker, 308 Yellowstone, Glendo, Wyo. 82213; Willis J. Patterson, 5224 Ridge Rd., Cheyenne, Wyo. 82009

[21] Appl. No.: 270,959

[22] Filed: Nov. 14, 1988

[51] Int. Cl.[4] ..... B63H 21/26

[52] U.S. Cl. ..... 114/144 RE; 114/144 A; 114/160; 440/53

[58] Field of Search ..... 114/144 R, 144 RE, 144 A, 114/146, 160, 161; 440/49, 53, 62, 63, 84, 6; 74/480 B

[56] References Cited

U.S. PATENT DOCUMENTS

| | | | |
|---|---|---|---|
| 2,408,929 | 6/1946 | Hammond | 114/144 RE |
| 2,499,471 | 3/1950 | Dunning | 114/144 RE |
| 2,928,631 | 3/1960 | Hartman | 248/4 |
| 2,939,658 | 6/1960 | Roemer | 248/4 |
| 2,951,460 | 9/1960 | Pierson | 114/144 |
| 2,988,037 | 6/1961 | Speicer | 114/160 |
| 2,993,464 | 7/1961 | Conover | 114/144 RE |
| 3,075,490 | 1/1963 | Lang | 440/53 |
| 3,080,953 | 3/1963 | Edgemond | 114/160 |
| 3,283,738 | 11/1966 | Nelson | 440/53 |
| 3,811,395 | 5/1974 | Decis | 114/144 RE |
| 3,968,768 | 7/1976 | Solt | 440/53 |

*Primary Examiner*—Sherman D. Basinger
*Assistant Examiner*—Clifford T. Bartz
*Attorney, Agent, or Firm*—Dean P. Edmundson

[57] ABSTRACT

Apparatus is described for controlling the steering of an outboard motor (e.g., a trolling motor) on a marine craft. The apparatus includes a frame for attachment to a mounting surface for the motor, a D.C. motor which can be driven in clockwise and counterclockwise directions, a capstan, a flexible cable extending between the ends of the frame and being connected to the capstan and the outboard motor, and switches for actuating the D.C. motor and controlling direction of rotation. The apparatus causes the outboard motor to be pivoted in the desired direction to steer the marine craft. The D.C. motor can be controlled from a remote location on the marine craft.

12 Claims, 4 Drawing Sheets

STEERING MECHANISM FOR OUTBOARD MOTOR

FIELD OF THE INVENTION

This invention relates to steering systems or mechanisms for outboard motors (e.g., trolling motors) on marine craft. More particularly, this invention relates to steering systems utilizing a D.C. motor to pivot the outboard motor relative to a mounting surface on the marine craft, to thereby steer the craft.

BACKGROUND OF THE INVENTION

Conventional outboard motors on marine craft (i.e., boats) ar mounted in a manner such that the motor can be pivoted about a vertical axis so as to steer the boat. Normally there is a vertically disposed pin (or pins) between the motor and the mounting clamp for the motor which allows the motor to be manually pivoted to the right or to the left for steering purposes. A handle is typically secured to the motor to allow the operator to pivot the motor, as desired.

The outboard motor may be detachably mounted to the transom of the boat or it may be mounted to a separate mounting plate or bracket supported by the boat. In certain instances the mounting plate or bracket may be vertically movable to permit the motor to be raised or lowered, as desired.

There have also been proposed remote control systems for enabling the operator to steer the boat from a remote location on the boat. Typically one or more switches are connected to a small electrical motor by wires, and the actuation of the switches causes the electric motor to effect pivotal movement of the outboard motor.

For example, in U.S. Pat. No. 3,968,768 there is described a steering system in which an outboard motor is mounted on a pivotable auxiliary transom. An electric motor is operably connected to the transom to cause selective pivoting movement of the transom in order to steer the boat. Other steering and support systems are described in U.S. Pat. Nos. 2,928,631; 2,939,658; 2,951,460; 3,075,490; 3,283,738; 2,583,059; 2,804,838; and 2,877,733.

However, such prior systems are not easily detached, and moved from one boat to another. Other of such systems are cumbersome or require relatively permanent mounting to the boat. Still others do not provide for remote control steering of the outboard motor.

There has not heretofore been provided improved apparatus for steering an outboard motor having the advantages exhibited by the present invention.

SUMMARY OF THE PRESENT INVENTION

In accordance with the present invention there is provided improved apparatus for steering an outboard motor which is pivotally mounted on a mounting surface on a marine craft. The apparatus may be remotely controlled.

In one embodiment the apparatus comprises:

(a) an elongated frame member having first and second ends;

(b) a D.C. motor carried by the first end of the frame member, the motor being adapted to be driven selectively in clockwise and counterclockwise directions;

(c) a capstan carried by the first end of the frame member and being rotatably driven by the D.C. motor;

(d) a flexible drive member driven by the capstan and extending between the first and second ends of the frame member;

(e) connection means for connecting the flexible drive member to the outboard motor; and (f) actuation means operably connected to the D.C. motor and being adapted to cause the D.C. motor to be driven selectively in clockwise and counterclockwise directions.

Actuation of the D.C. motor causes the capstan to be driven either in a clockwise or counterclockwise direction, as desired, in order to cause the outboard motor to be pivoted in a desired direction relative to the mounting surface in order to steer the craft.

The outboard motor is typically conventionally mounted on either the transom of the craft or on a special mounting surface (e.g., a plate or bracket on which a trolling motor is detachably mounted). Some types of mounting plates can be raised and lowered in order to raise and lower the outboard motor. The steering apparatus of this invention can be used regardless of the manner in which the outboard motor is mounted.

In another embodiment of the invention the D.C. motor and the capstan are carried or supported on a support arm secured to the outboard motor. The capstan engages a connection member (e.g., a flexible cable) extending between two spaced-apart arms. When the D.C. motor is actuated it drives the capstan and causes the support arm to move left or right, as desired, to pivot the outboard motor relative to the mounting surface.

The steering mechanism of the invention can be used for controlling the steering of virtually any pivotally mounted outboard on any type of marine craft. It is not permanently secured; thus, it can be moved from one craft to another very easily at an time.

Other advantages of the apparatus of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
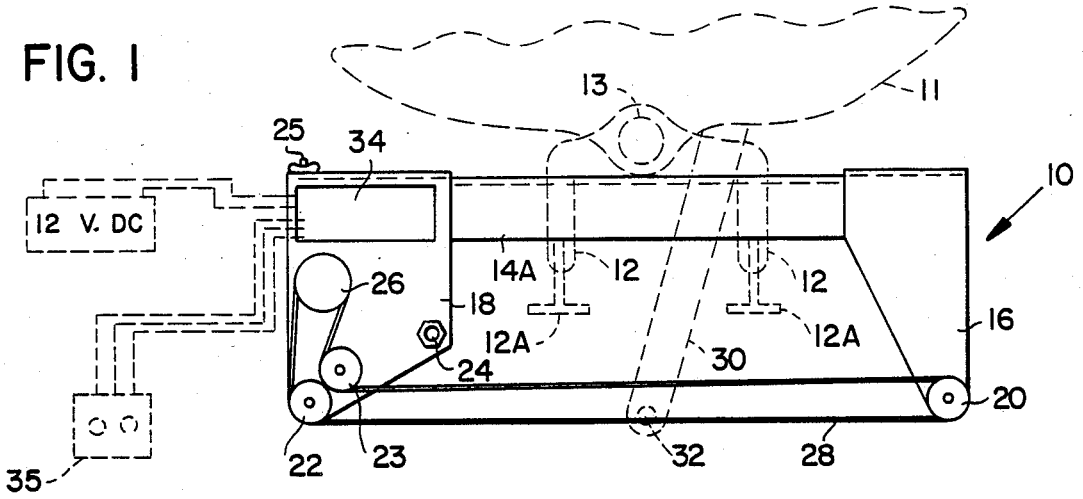
FIG. 1 is a top plan view illustrating one embodiment of the apparatus of the invention.
Figure 2:
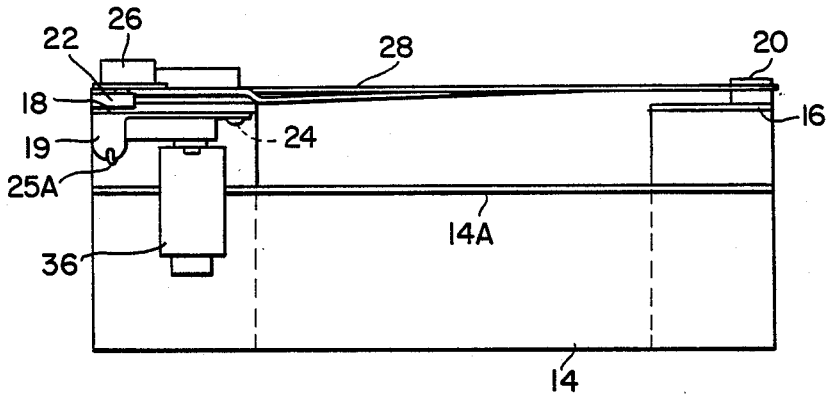
FIG. 2 is a front elevational view of the apparatus shown in FIG. 1.
Figure 3:
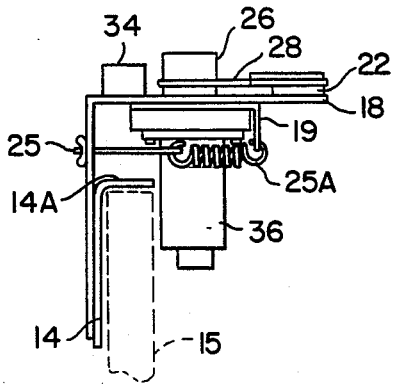
FIG. 3 is an end elevational view of the apparatus shown in FIG. 1.

In FIGS. 1–3 there is illustrated one embodiment of apparatus 10 of the invention for steering an outboard motor 11 which is pivotally mounted on a marine craft. For example, the outboard motor may be a trolling motor which is detachably mounted to a transom or other mounting bracket or mounting surface 15 on the craft by means of mounting clamps 12. Threaded bolts 12A in the clamps allow for tightening against the mounting surface to hold the outboard motor in place.

The front of outboard motor 11 is pivotally connected to the mounting clamps by means of vertical pin 13. This enables the motor 11 to be pivoted to the right or to the left in order to steer the craft.

The steering apparatus includes an elongated frame member 14 comprising a vertical plate having a horizontal lip member 14A. The plate is adapted to rest against the vertical outer surface of the transom or mounting surface 15 while the horizontal lip 14A is adapted to rest on the upper edge of the transom or mounting surface 15, as illustrated best in FIG. 3.

The mounting clamps of the outboard motor also secure the frame 14 in place when the outboard motor is clamped to the mounting surface 15. Thus, the steering apparatus of this invention can be used on any type of marine craft to which an outboard motor can be mounted. No separate fasteners or holes are required in order to use the steering apparatus. No permanent modification of the marine craft is required in order to use the apparatus of this invention.

At one end of the frame 14 there is an arm 16 which extends forwardly in a horizontal plane. At the outer end of arm 16 there is a rotatable pulley 20.

At the opposite end of frame 14 there is another arm 18 which extends forwardly in a horizontal plane. Pulleys 22 and 23 are rotatably mounted at the outer end of the arm 18.

Beneath arm 18 there is a horizontal plate 19 to which a D.C. motor 36 is attached. Capstan 26 is operably connected to motor 36 so that it can be driven by motor 36. Capstan 26 is disposed above arm 18 and is on the end of a driven shaft which extends through an opening in arm 18.

Plate 19 is pivotable about bolt 24 which connects it to arm 18. Bolt 25 and spring 25A are connected to one side of plate 19 and are adapted to pivot plate 19 relative to arm 18 so as to maintain the desired tension on flexible cable 28. The opening in arm 18 through which the shaft passes on which capstan 26 is mounted is slotted to allow the plate 19 to pivot with capstan 26 carried thereby.

An elongated rigid arm 30 is secured at one end to the outboard motor 11 and is attached at its outer end to flexible cable 28 (e.g., by means of a bolt or fastener 32). Thus, as the flexible cable 28 is driven in one direction or the other by capstan 26 the arm 30 causes the outboard motor to pivot about pin 13 either left or right. In this manner the marine craft is steered. The transom or mounting surface 15 does not rotate or otherwise move.

A battery or other source of D.C. power is operably connected to motor 36 through housing 34 which includes reversing contactors. Also, switch means 35 is connected to housing 34 by means of flexible wires. This enables the switch means to be located at any desired location on the craft for remote control of the steering. The switch means includes at least two switches (which may be operated by hand or by foot) to enable control of the direction of rotation of the D.C. motor (i.e., either clockwise or counterclockwise direction, as desired).

Figure 4:
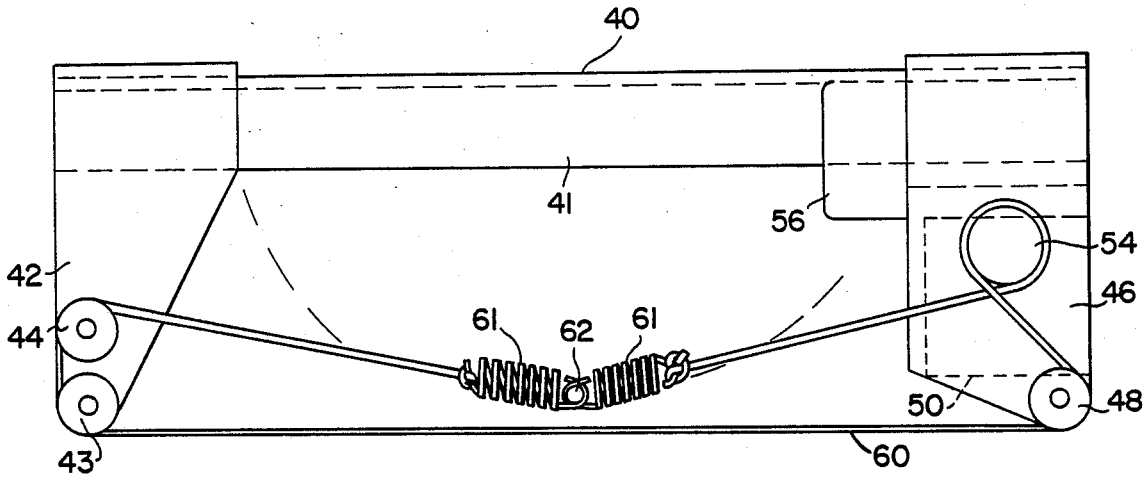
FIG. 4 is a top plan view illustrating another embodiment of apparatus of the invention.
Figure 5:
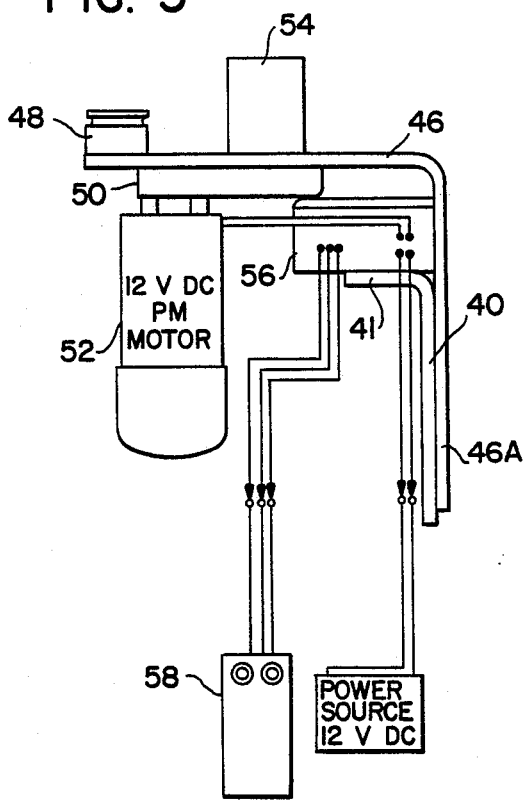
FIG. 5 is an end elevational view of the embodiment shown in FIG. 4.

FIGS. 4 and 5 illustrate another embodiment of steering apparatus of the invention comprising an elongated frame member 40 having a horizontal lip 41 extending along the length of frame 40. At one end there is a forwardly projecting arm 42 on which there are rotatably mounted two pulleys 43 and 44.

At the opposite end of frame 40 there is a forwardly projecting arm 46 having pulley 48 rotatably mounted on the outer end. The lower end portion 46A of arm 46 is secured to frame 40.

Beneath arm 46 there is located gear box 50 to which a D.C. motor 52 is operably connected. A shaft extends upwardly through an opening in arm 46 to drive capstan 54 located on the upper surface of arm 46. Housing 56 includes appropriate reversing contactors (which may be electromechanical or solid state to control the direction of rotation of the motor). Switch means 58 is connected to housing 56 by means of flexible wires, as illustrated. A battery or other D.C. power source is also operably connected to the housing 56. The switches can be actuated by hand or foot to cause the D.C. motor to be driven in either a clockwise or counterclockwise direction.

A flexible cable or cord 60 (e.g., nylon) encircles the capstan and passes around the pulleys 43, 44 and 48. Each end of the cable is attached to a spring 61, and the springs are attached to bolt or pin 62 to be fastened to an elongated arm secured to the forward portion of an outboard motor. The springs 61 maintain proper tension on cable 60 and also absorb vibration, if any, developed by the outboard motor.

Thus, the steering apparatus shown in FIGS. 4 and 5 is adapted to be placed adjacent the transom or mounting bracket or surface of a marine craft. Then the clamps of the outboard motor also secure the steering apparatus in place in the manner described above in connection with the apparatus of FIGS. 1–3. The horizontal lip 41 of frame 40 rests on top of the transom or other mounting surface.

Figure 6:
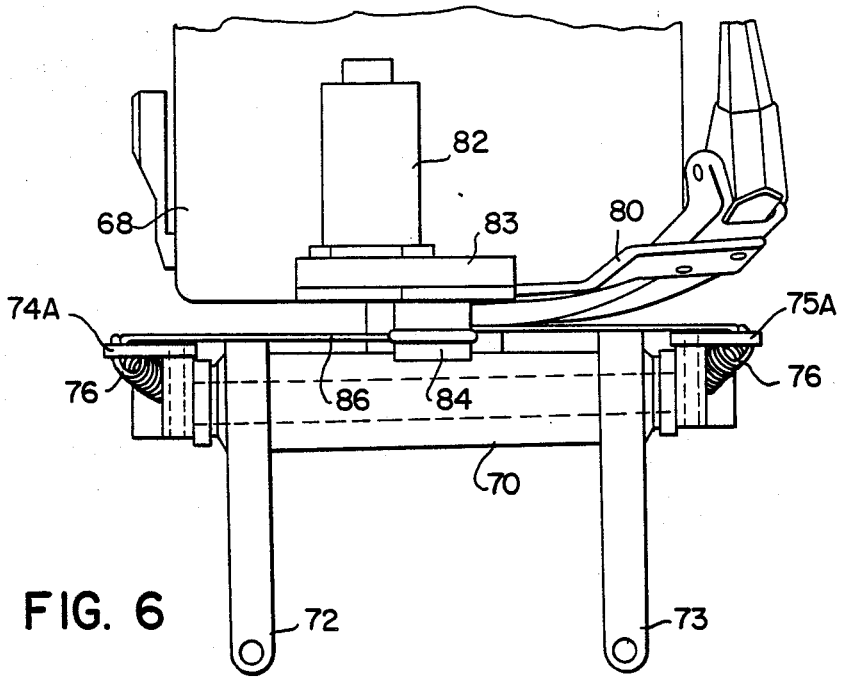
FIG. 6 is a front elevational view illustrating another embodiment of steering mechanism of the invention.
Figure 7:
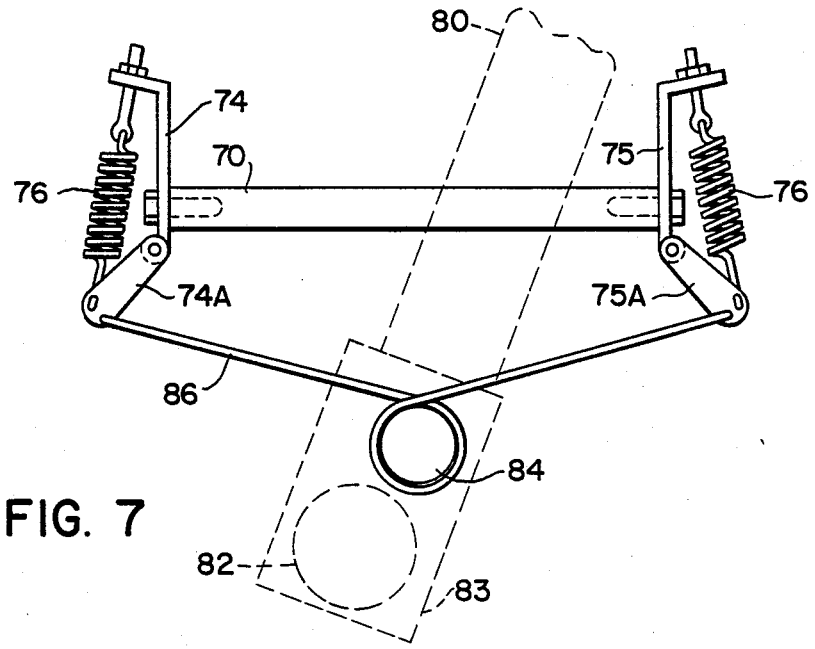
FIG. 7 is a top plan view of the apparatus shown in FIG. 6.

In FIGS. 6 and 7 there is illustrated another embodiment of steering apparatus which is useful in this invention. Elongated frame 70 is horizontally disposed and has transversely extending arms 74 and 75 secured to the ends of frame 70. Pivotable arm portions 74A and 75A are carried by each arm 74 and 75, respectively. A spring 76 is connected between the outer end of each arm portion 74A and 75A and the opposite end of arm 74 and 75, respectively, as illustrated. The springs 76 bias the arm portions 74A and 75A away from each other.

Elongated arm 80 is secured at one end to outboard motor 68. The opposite end of arm 80 supports D.C. motor 82 and gear box 83 on its upper surface. A capstan 84 driven by motor 82 is disposed below the arm 80. A flexible cable or cord 86 is connected at one end to the outer end of arm portion 74A and is connected at its opposite end to the outer end of arm portion 75A. Cable 86 also encircles capstan 84.

A source of D.C. current is operably connected to motor 82, and appropriate switch means is also operably connected to the motor 82 by flexible wires so as to enable the operator to control the motor 82 from a remote location on the marine craft in the manner described above.

Clamp members 72 and 73 carried by outboard motor 68 are adapted to retain frame 70 against the transom or other mounting surface of the marine craft while also retaining the outboard motor in place.

When the motor 82 is actuated to be driven in one direction or the other, the arm 80 is forced to move in a given direction to thereby pivot the outboard motor 68 relative to the transom or other mounting surface to steer the marine craft.

Figure 8:
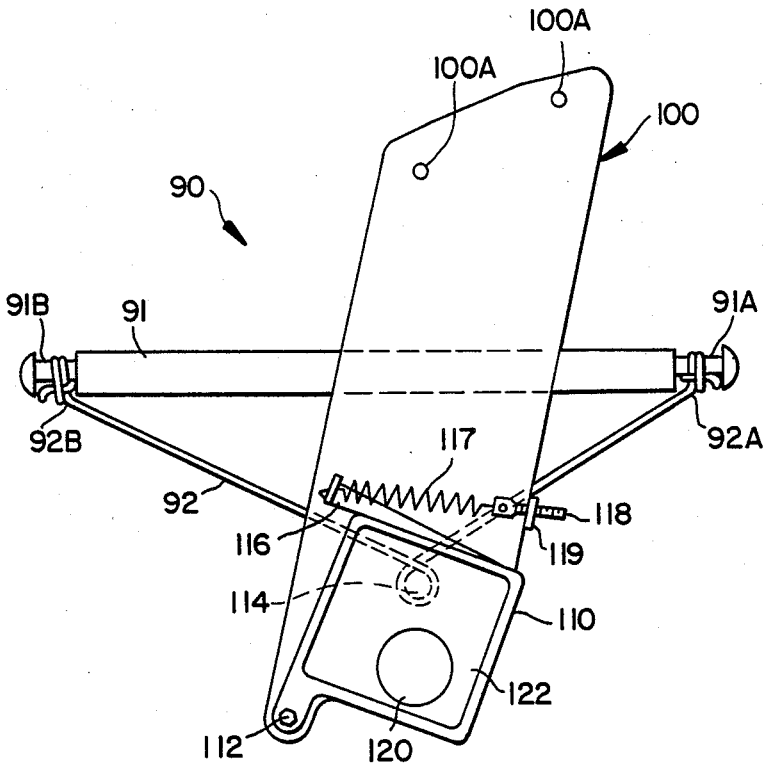
FIG. 8 is a top plan view of another embodiment of apparatus of the invention.

Yet another embodiment of steering apparatus 90 of the invention is illustrated in FIG. 8. Thus, there is shown elongated frame or base member 91 having opposite end portions 91A and 91B of slightly smaller diameter for facilitating connection of the ends 92A and 92B, respectively, of flexible cord or cable 92.

Elongated support arm 100 includes apertures 100A at one end to facilitate attachment to the outboard motor. On the opposite end of arm 100 there is carried a plate 110 which is pivoted on bolt 112 extending through plate 110 and arm 100. A D.C. motor 120 is carried on top of gear box 122 on plate 110. A capstan 114 is located below arm 100 and is rotatably driven by a shaft extending downwardly through a slotted opening in arm 100. Flexible cord or cable 92 encircles the capstan.

Arm 116 secured to plate 110 is connected to a spring 117 which in turn is connected to one end of a threaded bolt 118 carried by anchor 119 on the edge of arm 100. The spring 117 biases the plate 110 in a manner such that tension is maintained on flexible cable 92. The amount of tension can be adjusted by disconnecting the spring, adjusting the position of bolt 118 relative to anchor 119, and re-connecting the spring to bolt 118.

As the capstan is driven in one direction or the other, the arm 100 is caused to move left or right to thereby pivot the outboard motor to steer the marine craft.

The elongated frame or base 91 may be placed adjacent the transom or mounting surface on the marine craft and then held there by the mounting clamps for the outboard motor. It is also possible to mount this type of steering apparatus directly to the mounting clamp mechanism of the outboard motor. It is also possible to enclose the apparatus within an appropriate housing on the outboard motor mounting mechanism (e.g., at the factory at the time of original manufacture).

The steering apparatus of this invention can be used on any marine craft having an outboard motor pivotally mounted on a transom or other mounting surface. The motor may be either an internal combustion engine or an electrically powered motor. The apparatus can be easily removed from one craft and used on another, as desired.

Other variants are possible without departing from the scope of this invention.

What is claimed is:

1. Apparatus for connection to a marine craft having an outboard motor pivotally mounted on a mounting surface on said marine craft by means of a clamp, said apparatus being adapted to pivot said outboard motor relative to said mounting surface in order to steer said marine craft; wherein said apparatus comprises:

(a) an elongated frame member having first and second ends; said frame member being supported and carried by said clamp;

(b) a support arm having first and second ends; wherein said first end is adapted to be attached to said outboard motor; wherein said second end projects forwardly of said outboard motor;

(c) a D.C. motor carried by said second end of said support arm; said D.C. motor being adapted to be driven selectively in clockwise and counterclockwise directions;

(d) a capstan carried by said support arm and being rotatably driven by said D.C. motor;

(e) a flexible connection member connection between said first and second ends of said frame member;

(f) actuation means operably connected to said D.C. motor and being adapted to cause said D.C. motor to be driven selectively in clockwise and counterclockwise directions;

wherein said capstan engages said connection member in a manner such that rotation of said capstan by said D.C. motor causes said outboard motor to pivot with respect to said mounting surface, whereby said marine craft is steered.

2. Apparatus in accordance with claim 1, further comprising first and second arm members projecting outwardly from one side of said first and second ends, respectively, of said frame member; and wherein said connection member is connected between said first and second arm members.

3. Apparatus in accordance with claim 2, wherein said first and second arm members are pivotably attached to said first and second ends, respectively, of said frame member; further comprising first and second spring members for biasing said arm members in opposite directions.

4. Apparatus in accordance with claim 1, wherein said connection member comprises a flexible cable which encircles said capstan.

5. Apparatus in accordance with claim 1, wherein said actuation means comprises switches connected to said D.C. motor by means of elongated flexible wires.

6. Apparatus for connection to a marine craft having an outboard motor pivotally mounted on a mounting surface on said marine craft, said apparatus being adapted to pivot said outboard motor relative to said mounting surface in order to steer said marine craft; wherein said apparatus comprises:

(a) an elongated frame member having first and second ends; wherein said frame member includes first and second arms projecting outwardly from one side of said first and second ends, respectively;

(b) a D.C. motor carried by said first arm; said motor being adapted to be driven selectively in clockwise and counterclockwise directions;

(c) a capstan carried by said first arm and being rotatably driven by said D.C. motor;

(d) a pulley rotatably mounted on said second arm;

(e) an endless flexible drive cable extending around said capstan and said pulley; said drive cable being adapted to be driven by said capstan;

(f) connection means for connecting said flexible drive cable to said outboard motor; and (g) actuation means operably connected to said D.C. motor for causing said D.C. motor to be driven selectively in clockwise and counterclockwise directions;

wherein actuation of said D.C. motor to selectively drive said capstan in one direction causes pivotal movement of said outboard motor relative to said mounting surface, whereby said marine craft is steered.

7. Apparatus in accordance with claim 6, wherein said connection means comprises a rigid connection arm having a first end secured to said outboard motor and a second end secured to said cable.

8. Apparatus in accordance with claim 6, wherein said frame member comprises a vertical plate having a horizontal lip on its top edge.

9. Apparatus for connection to a marine craft having an outboard motor pivotally mounted on a mounting surface on said marine craft, said apparatus being adapted to pivot said outboard motor relative to said mounting surface in order to steer said marine craft; wherein said apparatus comprises:

(a) an elongated frame member having first and second ends;

(b) a D.C. motor carried by said first end of said frame member, said motor being adapted to be driven selectively in clockwise and counterclockwise directions;

(c) a capstan carried by said first end of said frame member and being rotatably driven by said D.C. motor;

(d) a flexible drive member driven by said capstan and extending between said first and second ends of said frame member;

(e) connection means for connecting said flexible drive member to said outboard motor; and (f) actuation means operably connected to said D.C. motor and being adapted to cause said D.C. motor to be driven selectively in clockwise and counterclockwise directions;

further comprising first and second arms attached to and projecting outwardly from one side of said first and second ends, respectively, of said frame member; wherein said capstan and said D.C. motor are mounted on said first arm; and further comprising a pulley rotatably mounted on said second arm; wherein said flexible drive member comprises an endless cable which extends around said capstan and said pulley; wherein actuation of said D.C. motor to selectively drive said capstan in one direction causes pivotal movement of said outboard motor relative to said mounting surface, whereby said marine craft is steered.

10. Apparatus in according with claim 9, wherein said frame member comprises a vertical plate including a horizontal lip; and wherein said frame member is adapted to be detachably connected to said mounting surface on said marine craft.

11. Apparatus in accordance with claim 10, wherein said actuation means comprises switches connected to said D.C. motor by means of elongated flexible wires.

12. Apparatus in accordance with claim 9, wherein said connection means comprises an arm having first and second ends, wherein said first end is fastened to said outboard motor and said second end is fastened to said flexible drive member.

* * * * *